US007568534B2

(12) United States Patent
Griffin et al.

(10) Patent No.: US 7,568,534 B2
(45) **Date of Patent: *Aug. 4, 2009**

(54) DUAL-EDGE WORKING SURFACES FOR POLYCRYSTALLINE DIAMOND CUTTING ELEMENTS

(75) Inventors: Nigel Dennis Griffin, Nympsfield (GB); Peter Raymond Hughes, Stroud (GB); Andrew Bell, Eastington (GB)

(73) Assignee: ReedHycalog UK Limited (GB)

( * ) Notice: Subject to any disclaimer, the term of this patent is extended or adjusted under 35 U.S.C. 154(b) by 0 days.

This patent is subject to a terminal disclaimer.

(21) Appl. No.: 12/037,312

(22) Filed: Feb. 26, 2008

(65) Prior Publication Data

US 2008/0142275 A1 Jun. 19, 2008

Related U.S. Application Data

(63) Continuation of application No. 11/163,323, filed on Oct. 14, 2005, now abandoned.

(30) Foreign Application Priority Data

Oct. 23, 2004 (GB) ..... 0423597.4

(51) Int. Cl.
*E21B 7/00* (2006.01)

(52) U.S. Cl. ..... 175/57; 175/430

(58) Field of Classification Search ..... 175/426, 175/428, 430, 432, 434, 57
See application file for complete search history.

(56) References Cited

U.S. PATENT DOCUMENTS

| | | | | |
|---|---|---|---|---|
| 6,248,447 | B1 * | 6/2001 | Griffin et al. | 428/408 |
| 2006/0060391 | A1 * | 3/2006 | Eyre et al. | 175/434 |
| 2007/0039762 | A1 * | 2/2007 | Achilles | 175/434 |

FOREIGN PATENT DOCUMENTS

WO WO 00/28106 * 5/2000

* cited by examiner

*Primary Examiner*—Daivd J Bagnell
*Assistant Examiner*—David Andrews
(74) *Attorney, Agent, or Firm*—Jeffery E. Daly

(57) ABSTRACT

A polycrystalline diamond cutting element for earth boring drill bits presents regions of different abrasion resistance to the earthen formation when in operation. The cutting element has an end working surface and a region which is substantially free of catalyzing material, forming a layer. In operation, this layer wears at a different rate than the underlying material causing a pair of protruding lips to form. The end working surface may be substantially planar or frusto-conical in form.

1 Claim, 5 Drawing Sheets

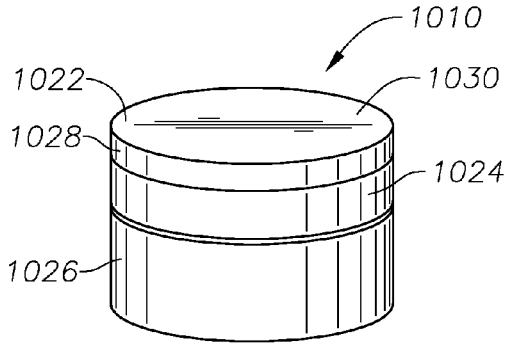
Fig. 1
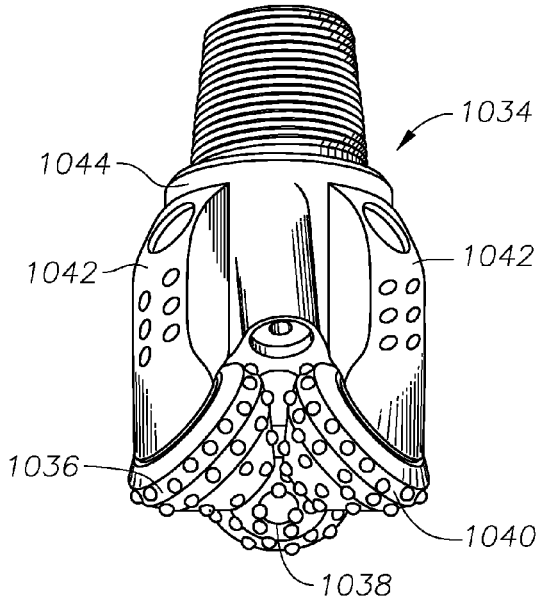
Fig. 4
Fig. 2
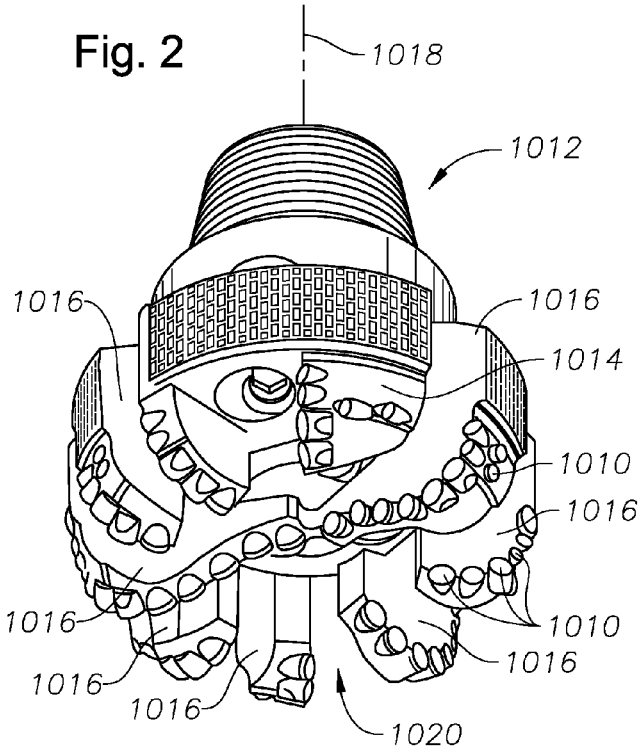
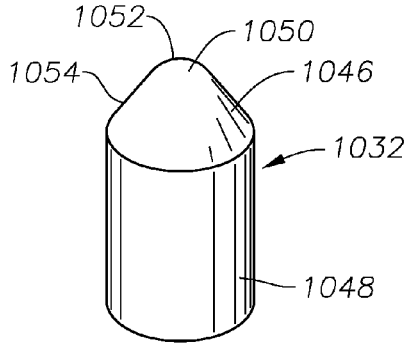
Fig. 3

DUAL-EDGE WORKING SURFACES FOR POLYCRYSTALLINE DIAMOND CUTTING ELEMENTS

CROSS-REFERENCE TO RELATED APPLICATIONS

This application is a Continuation Application of U.S. patent application Ser. No. 11/163,323 entitled "Dual-Edge Working Surfaces for Polycrystalline Diamond Cutting Elements", filed on Oct. 14, 2005 now abandoned, incorporated by reference herein for all it contains, which claims priority from GB Provisional application 0423597.2, filed on Oct. 23, 2004.

BACKGROUND OF THE INVENTION

1. Field of the Invention

The invention relates to superhard polycrystalline material elements for earth drilling, cutting, and other applications where engineered superhard surfaces are needed. The invention particularly relates to polycrystalline diamond and polycrystalline diamond-like (collectively called PCD) elements with dual edged working surfaces.

2. Description of the Related Art

Polycrystalline diamond and polycrystalline diamond-like elements are known, for the purposes of this specification, as PCD elements. PCD elements are formed from carbon based materials with exceptionally short inter-atomic distances between neighboring atoms. One type of diamond-like material similar to PCD is known as carbonitride (CN) described in U.S. Pat. No. 5,776,615. In general, PCD elements are formed from a mix of materials processed under high-temperature and high-pressure into a polycrystalline matrix of inter-bonded superhard carbon based crystals. A common trait of PCD elements is the use of catalyzing materials during their formation, the residue from which, often imposes a limit upon the maximum useful operating temperature of the element while in service.

A well known, manufactured form of PCD element is a two-layer or multi-layer PCD element where a facing table of polycrystalline diamond is integrally bonded to a substrate of less hard material, such as tungsten carbide. The PCD element may be in the form of a circular or part-circular tablet, or may be formed into other shapes, suitable for applications such as hollow dies, heat sinks, friction bearings, valve surfaces, indentors, tool mandrels, etc. PCD elements of this type may be used in almost any application where a hard wear and erosion resistant material is required. The substrate of the PCD element may be brazed to a carrier, often also of cemented tungsten carbide. This is a common configuration for PCD's used as cutting elements, for example in fixed cutter or rolling cutter earth boring bits when received in a socket of the drill bit, or when fixed to a post in a machine tool for machining.

PCD elements are most often formed by sintering diamond powder with a suitable binder-catalyzing material in a high-pressure, high-temperature press. One particular method of forming this polycrystalline diamond is disclosed in U.S. Pat. No. 3,141,746 herein incorporated by reference for all it discloses. In one common process for manufacturing PCD elements, diamond powder is applied to the surface of a preformed tungsten carbide substrate incorporating cobalt. The assembly is then subjected to very high temperature and pressure in a press. During this process, cobalt migrates from the substrate into the diamond layer and acts as a binder-catalyzing material, causing the diamond particles to bond to one another with diamond-to-diamond bonding, and also causing the diamond layer to bond to the substrate.

The completed PCD element has at least one body with a matrix of diamond crystals bonded to each other with many interstices containing a binder-catalyzing material as described above. The diamond crystals comprise a first continuous matrix of diamond, and the interstices form a second continuous matrix of interstices containing the binder-catalyzing material. In addition, there are necessarily a relatively few areas where the diamond-to-diamond growth has encapsulated some of the binder-catalyzing material. These 'islands' are not part of the continuous interstitial matrix of binder-catalyzing material.

In one common form, the diamond body constitutes 85% to 95% by volume and the binder-catalyzing material the other 5% to 15%. Such an element may be subject to thermal degradation due to differential thermal expansion between the interstitial cobalt binder-catalyzing material and diamond matrix beginning at temperatures of about 400 degrees C. Upon sufficient expansion the diamond-to-diamond bonding may be ruptured and cracks and chips may occur.

A common problem with these PCD elements, especially when used in highly abrasive cutting application, such as in drill bits, has been the limitation imposed between wear resistance and impact strength. This relationship has been attributed to the fact that the catalyzing material remaining in the interstitial regions among the bonded diamond crystals contributes to the degradation of the diamond layer.

It has become well known in the art to preferentially remove this catalyzing material from a portion of the working surface in order to form a surface with much higher abrasion resistance without substantially reducing its impact strength. This new type of PCD element is described in U.S. Pat. Nos. 6,601,662; 6,592,985 and 6,544,308 all these U.S. patents incorporated by reference herein for all they disclose.

PCD elements made in accordance with these and in other related patents have become widely used in the oilfield drilling industry. One surprising observation resulting from this usage, however, has been an increase in the cutting efficiency of these cutters, which has been manifested in higher drilling rates of penetration—typically by 40%, but occasionally by as much as a factor of two to four times.

In observing these PCD cutting elements in the worn condition, it was discovered that the differential wear rate caused a protruding lip to form on the wear edge of the working surface. This lip caused the PDC cutting element to appear 'sharper' to the earth formation being drilled, producing the higher drilling rates of penetration.

U.S. Pat. No. 4,976,324 describes an arrangement in which a vapour deposition technique is used to apply a catalyst free diamond layer to a surface of a cutting element, but it will be appreciated that the vapour deposition technique used does not bond the diamond layer to the underlying diamond table. U.S. Pat. No. 6,068,913 and U.S. Pat. No. 4,766,040 both describe multi-layered elements, and U.S. Pat. No. 6,187,068 describes providing the element with concentric ring shaped regions of different abrasion resistance.

An arrangement is described in U.S. Pat. No. 6,189,634 in which, when worn, part of the substrate of a cutting element becomes exposed at the working surface.

BRIEF SUMMARY OF THE INVENTION

The present invention is a PCD cutting element, which in operation (and as it wears to a worn condition) presents at least two cutting lips to the material being cut. One particularly advantageous use of this new PDC cutting element is as cutting elements for earth boring drill bits.

According to the present invention there is provided a cutting element comprising a table of superhard material bonded to a substrate of less hard material, the table of superhard material defining a plurality of interstices containing a catalyzing material, the table of superhard material defining an end working surface and a peripheral working surface, wherein at least part of the end working surface and at least part of the peripheral working surface are substantially free of catalyzing material. The catalyst free or substantially free parts may extend to a depth in the region of about 0.02 to about 0.70 mm, preferably about 0.15 to about 0.25 mm.

The element may have an edge of the part of the end working surface which is substantially free of catalyzing material which defines a first protruding lip, and an edge of the part of the peripheral working surface which is substantially free of catalyzing material defining a second protruding lip. The end working surface may be substantially planar, and the peripheral working surface may be substantially perpendicular thereto. Alternatively, the peripheral working surface may be of substantially frusto-conical form. The superhard material may be polycrystalline diamond, and may incorporate regions of different abrasion resistance, for example arranged in a series of layers, or in a series of concentric rings. The table of superhard material may incorporate encapsulated diamond material, for example made using powdery carbonate. A region of superhard material containing catalyzing material may be exposed between the parts of the peripheral working surface and the end working surface which are substantially free of catalyzing material. The first protruding lip may be formed adjacent said region at an edge of the part of the end working surface which is substantially free of catalyzing material and the second protruding lip may be formed adjacent said region at an edge of the part of the peripheral working surface which is substantially free of catalyzing material. The said region may be formed by machining away of material or be formed in use by part of the cutting element wearing.

As a cutting element for an earth boring drill bit, one of the protruding lips of the cutting element forms or is formed on a first working surface presented from generally 10 degrees normally, to up to 45 degrees backrake to an earthen formation as the bit is operated to drill into the earth. The second lip forms or is formed on a second working surface which adjoins the first working surface and may be (but is not necessarily required to be) normal to the first working surface. The PDC cutting element is oriented and operated in a manner that presents both working surfaces to the earthen formation as the drill bits progresses into the earth.

The invention also relates to a method of manufacturing a cutting element comprising forming a table of superhard material bonded to a less hard substrate, the table of superhard material defining a plurality of interstices containing a catalyzing material, the table defining an end working surface and a peripheral working surface, and treating at least part of each of the end working surface and the peripheral working surface to remove the catalyzing material therefrom. A further step of exposing untreated superhard material between the end and peripheral working surfaces, may be incorporated. The step of exposing may comprise machining away treated material.

BRIEF DESCRIPTION OF THE DRAWINGS

FIG. 1 is a perspective view of a PCD element of an embodiment of the present invention in the form of a planar-face cutting element.

FIG. 2 is a perspective view of a fixed cutter drill bit suitable for using the PCD elements of the present invention.

FIG. 3 is a perspective view of a PCD element of the present invention in the form of a domed-face cutting element.

FIG. 4 is a perspective view of a rolling cutter drill bit suitable for using the PCD elements of the present invention.

DETAILED DESCRIPTION OF THE INVENTION AND THE PREFERRED EMBODIMENT

Figure 5:
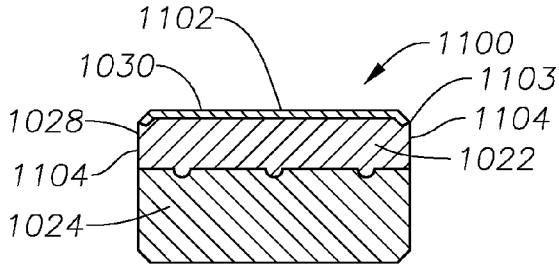
Fig. 5 (Prior Art)
FIG. 5 is a section view of a prior art PCD cutting element.

Referring now to FIGS. 1-4, the polycrystalline diamond and polycrystalline diamond-like (PCD) element 1010 of the present invention may be a preform cutting element 1010 for a fixed cutter rotary drill bit 1012 (as shown in FIG. 1). The bit body 1014 of the drill bit is formed with a plurality of blades 1016 extending generally outwardly away from the central longitudinal axis of rotation 1018 of the drill bit. Spaced apart side-by-side along the leading face 1020 of each blade is a plurality of the PCD cutting elements 1010 of the present invention.

Typically, the PCD cutting element 1010 has a body in the form of a circular tablet having a thin front facing table 1022 of diamond or diamond-like (PCD) superhard material, bonded in a high-pressure high-temperature press to a substrate 1024 of less hard material such as cemented tungsten carbide or other metallic material. The cutting element 1010 is preformed and then typically bonded on a generally cylindrical carrier 1026 which is also formed from cemented tungsten carbide, or may alternatively be attached directly to the blade. The PCD cutting element 1010 has peripheral and end working surfaces 1028 and 1030 which, as illustrated, are substantially perpendicular to one another.

The cylindrical carrier 1026 is received within a correspondingly shaped socket or recess in the blade 1016. The carrier 1026 will usually be brazed, shrink fit or press fit in the socket. Where brazed, the braze joint may extend over the carrier 1026 and part of the substrate 1024. In operation the fixed cutter drill bit 1012 is rotated and weight is applied. This forces the cutting elements 1010 into the earth being drilled, effecting a cutting and/or drilling action.

In a second embodiment, a shaped cutting element 1032 (as shown in FIG. 3) of the present invention is provided on a rolling cutter type drill bit 1034, shown in FIG. 4. A rolling cutter drill bit 1034 typically has one or more truncated rolling cone cutters 1036, 1038, 1040 assembled on a bearing spindle on the leg 1042 of the bit body 1044. The cutting elements 1032 may be mounted, for example by press fitting as one or more of a plurality of cutting inserts arranged in rows on rolling cutters 1036, 1038, 1040, or alternatively the PCD cutting elements 1032 may be arranged along the leg 1042 of the bit 1034. The PCD cutting element 1032 has a body in the form of a facing table 1046 of diamond or diamond like material bonded to a less hard substrate 1048. The facing table 1046 in this embodiment of the present invention is in the form of a convex surface 1050 and has peripheral and end working surfaces 1052 and 1054. Accordingly, there are often a number of transitional layers between the facing table 1046 and the substrate 1048 to help more evenly distribute the stresses generated during fabrication, as is well known to those skilled in the art. The end working surface 1052 is of domed or part-spherical form whilst the peripheral working surface 1054 is of frusto-conical form.

In operation the rolling cutter drill bit 1032 is rotated and weight is applied. This forces the cutting inserts 1032 in the rows of the rolling cone cutters 1036, 1038, 1040 into the earth, and as the bit 1036 is rotated the rolling cutters 1036, 1038, 1040 turn, effecting a drilling action.

Figure 17:
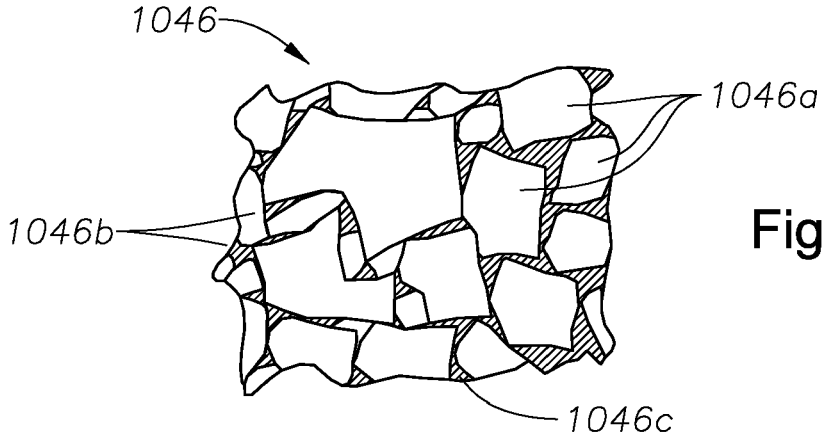
FIG. 17 is a diagrammatic view illustrating the structure of part of a cutter.

As illustrated in FIG. 17, the structure of the table 1046 defines a series of interstices 1046*a* between the diamond crystals 1046*b*, the interstices 1046*a* containing binder catalyst material 1046*c* used during the synthesis of the table 1046.

The remaining discussion and description of the present invention will be drawn, by way of example, to the planar face type of cutting element 1010 shown in FIG. 1. It is understood, however, that the same general principals and outcomes will apply as well to the domed type cutting element 1032, as shown in FIG. 3.

Figure 6:
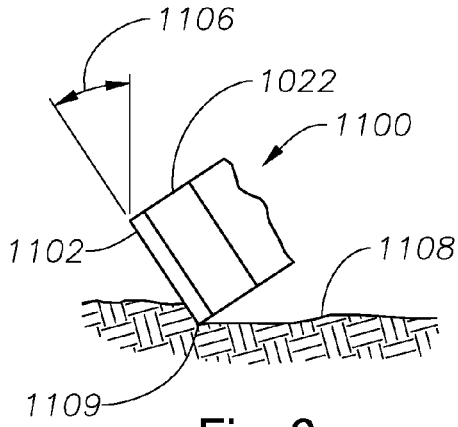
Fig. 6 (Prior Art)
FIG. 6 is a perspective view of a prior art planar face PCD cutting element drilling into the earth.

A cross section view of a preform cutting element of the prior art 1100 is shown in FIGS. 5 and 6 to illustrate and contrast the present invention. The prior art cutting element 1100 shares many elements in common with the PCD cutting element 1010, 1048, 1112, 1114, 1116, 1118, 1120 and 1122 of the present invention, such as having a relatively thin front facing table 1022 of diamond, bonded to a substrate 1024 of cemented tungsten carbide. All the cutting elements 1010, 1048, 1112, 1114, 1116, 1118, 1120, 1122 and 1100 have working surfaces 1028 and 1030. A layer 1102 of the facing table 1022 in many of these cutting elements is treated in a manner such that the catalyzing material is substantially removed from a relatively thin layer adjacent to the end working surface 1030. Removal of the catalyzing material in this manner had been found to greatly increase the wear resistance of the cutting element, and to surprisingly increase its drilling rate.

Note, however, that the peripheral working surface 1028 on the outside periphery 1104 on the prior art cutting element 1100 was not treated to remove the catalyzing material. The cutting element 1100 is operated in a manner as illustrated in FIG. 6. This is a typical representation in which the cutting element 1100 is operated at a backrake angle 1106 of from typically 10 to 45 degrees. When operated in this manner, the treated layer 1102 of the facing table 1022 is presented to the earth formation 1108.

In the present invention—as represented by FIGS. 7-16 a plurality of protruding lips 1110 form as the cutter 1010, 1112, 1114, 1116, 1118, 1120 drills into the earth formation 1108. As a cutting element for earth boring drill bits, one of the protruding lips 1110 of the cutting element forms or is formed on a first working surface 1030 presented from about 10 up to about 45 degrees backrake to an earthen formation 1108 as the bit is operated to drill into the earth 1108. The second lip 1110 forms or is formed on a second working surface 1028 which adjoins the first working surface 1030 and is generally, but not necessarily normal to the first working surface 1030. The PDC cutting element is oriented and operated in a manner that presents both working surfaces 1028, 1030 to the earthen formation 1108 as the drill bits 1012, 1034 progress into the earth.

In the prior art cutter 1100, as shown in FIGS. 5 and 6, a single lip 1109 would often form as the cutter 1100 began to wear when drilling. The inventors believed that this lip 1109 formed because the layer 1102 had higher abrasion resistance than the other diamond material. What was not appreciated at the time of that invention was that this lip tended to increase the drilling rate of penetration by a factor of two and often more. The mechanism behind this increase in rate of penetration is believed to be the interaction of the lip 1109 with the earth formation 1108 during drilling. As drilling progresses, the underlying diamond wears from beneath the lip 1109 causing ever further protrusion. Once this protrusion reaches a critical amount the lip fractures. This changes the cutting geometry of the cutter 1100 in a manner that tends to make it self-sharpening—as when the lip fractures, the lines of stress cause a cup-shaped or crescent-shaped portion of the facing table to be lost. Until the lip re-forms, however, the cutters 1100 will not be as sharp, and at least for a period of time will not drill as efficiently. However, there are typically many of these cutters 1100 on a drill bit 1012 so the average drilling rate of penetration remains relatively stable. This is overall a more efficient cutting shape than the flats that tend to wear onto diamond tables of untreated cutters, however. As shown in FIG. 5, the treated surface layer 1102 ended at the edge 1103 of the prior art cutter 1100, and it is at this edge 1103 that the lip 1109 forms.

Figure 10:
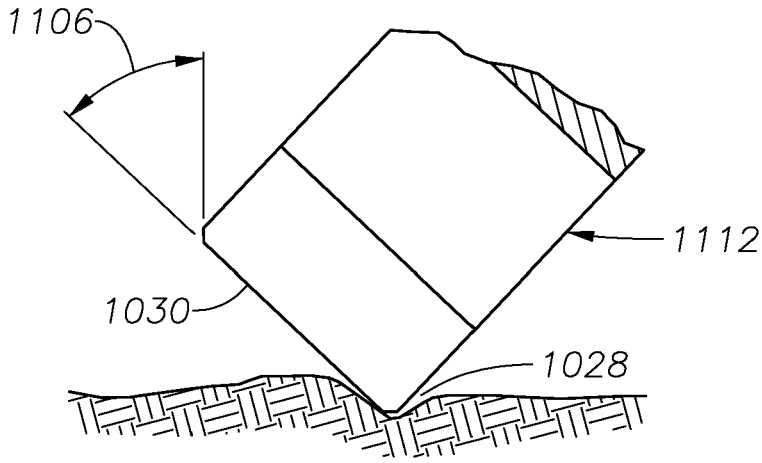
FIG. 10 is a partial sectional view of one type of cutter of the present invention, drilling into the earth.
Figure 11:
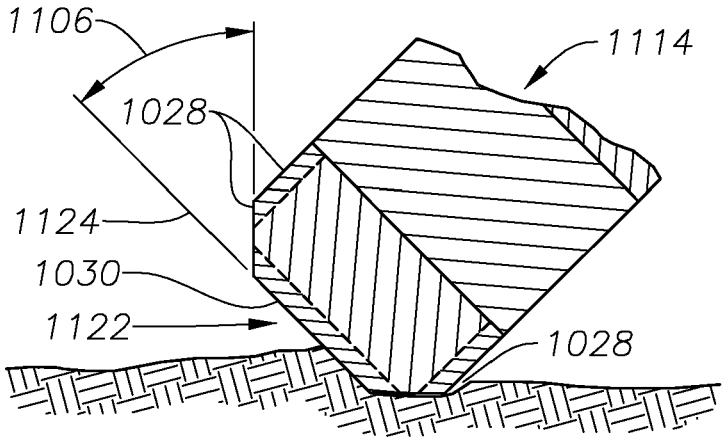
FIG. 11 is a partial sectional view of a second geometry for a cutter of the present invention, drilling into the earth.

Although there are a nearly infinite number of possible geometrical shapes for the cutters 1010, 1112, 1114, 1116, 1118, 1120 of the present invention, two preferred shapes are shown in FIGS. 10 and 11. FIG. 10 shows a generally right circular cylindrical shape cutter 1112 (similar to cutting element 1010 in FIG. 1). The cutter 1112 is shown in partial section view mounted on the face of a drill bit 1012 and drilling the formation 1108. The cutter 1112 is shown orientated at a backrake 1106 from a line parallel to the longitudinal axis 1018 of the drill bit 1012.

In FIG. 11, a second preferred shape for a cutter 1114, is also shown orientated at a backrake 1106 from a line parallel to the longitudinal axis 1018 of the drill bit 1012. Its cutting face 1122 is formed as a truncated cone, with the cone angle 1124 approximately equal to the backrake angle 1106. It may be synthesized to this form, or may be machined to be of this form. This cutter 1122 is also shown in partial section view mounted on the face of a drill bit 1012 and drilling the formation 1108. The advantages of this configuration will be explained later in this specification.

FIGS. 7, 8, 9A, and 9B show three ways to form cutters which produce the protruding lips 1110, and which may be used or adapted for use in the formation of cutters having the configurations shown in FIGS. 10 and 11.

Figure 7:
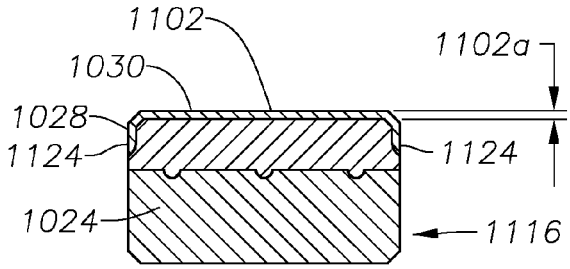
FIG. 7 is a section view of a planar face PCD cutting element of the present invention.
Figure 12:
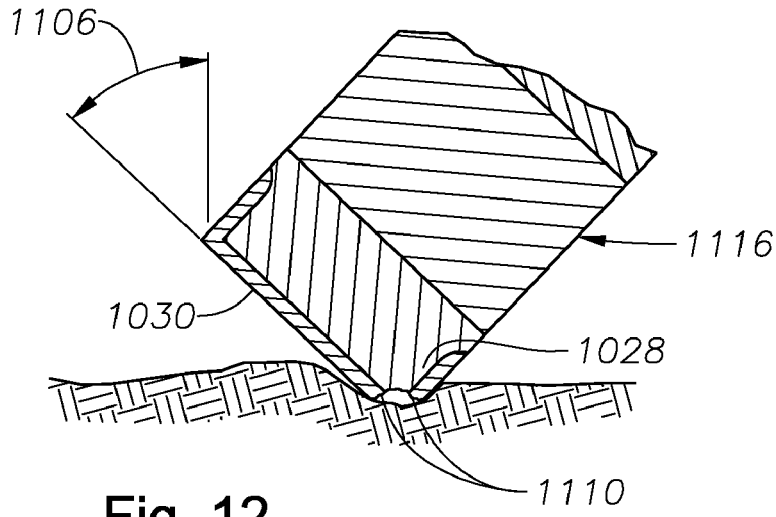
FIG. 12 is a partial sectional view of the cutter of FIG. 7, drilling into the earth.

In FIG. 7 a cutter 1116 of the preferred embodiment has a layer 1030 which is treated in much the same manner as in the prior art cutters 1100 shown in FIGS. 5 and 6. However, in the cutter 1116 of the present invention, the treatment is applied additionally to the outside periphery 1124 of cutter 1116. As shown in FIG. 12, the representation of this cutter 1116 after drilling for a short period of time, as the cutter wears, two lips 1110 form. This configuration has been shown to increase the drilling rate of penetration of the preferred embodiment cutter 1116 by as much as 40% of the prior art cutter 1100—which is a total of approximately a 50% to 60% improvement in rate of penetration of cutters without the wear resistant layer shown of the cutter 1100 shown in FIGS. 5 and 6—but otherwise similar in shape and mode of operation.

As mentioned hereinbefore, the treatment forms a relatively thin layer 1102 which is free of or substantially free of catalyzing material. The depth or thickness 1102*a* of the layer 1102 conveniently falls within the range of about 0.02 to about 0.70 mm, preferably about 0.15 to about 0.25 mm.

It is believed that this improvement in rate of penetration is due to a synergistic relationship between the plurality of lips 1110 that form as the cutter 1116 drills. As described above, as the lips 1110 fracture, the lines of stress cause a cup-shaped or crescent-shaped portion of the facing table to be lost. The plurality of lips, however interact, in that when one of the lips fractures, the cutting action may be transferred to another of the lips. The likelihood of the cutter having at least one sharp edge engaging the formation, at any given time is therefore improved, thus maintaining the drilling rate of penetration lost by the prior art cutters 1100 as shown in FIGS. 5 and 6, as while 'new' lip forms into a cutting edge after fracture the other lip is doing most of the drilling. It will be appreciated that the lips of a cutter may act on different parts of the formation being drilled, and that whilst a new lip is forming, at least some of the material which would have been cut by the fractured lip is instead cut by part of a radially adjacent cutter.

Figure 12A:
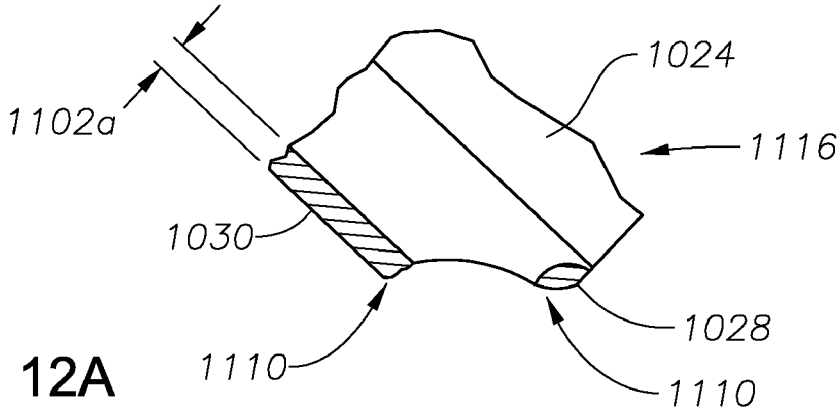
FIG. 12A illustrates the cutter of FIG. 7 when worn.
Figure 13:
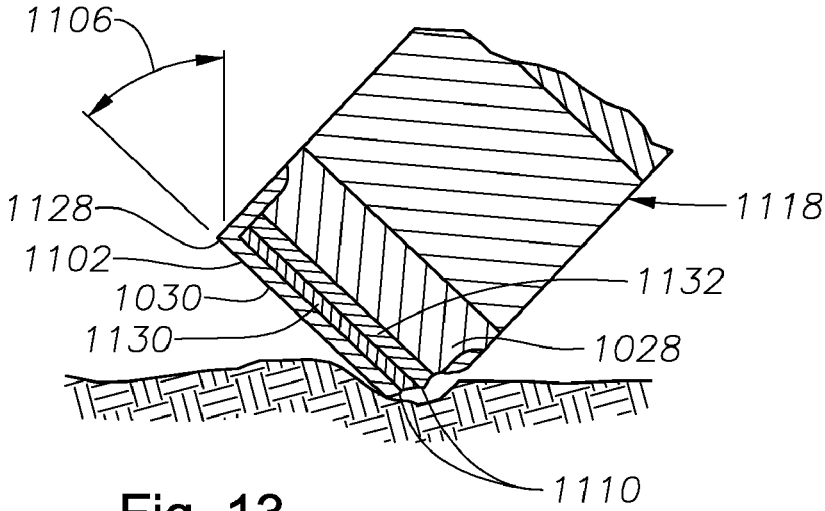
FIG. 13 is a partial sectional view of the cutter of FIG. 8, drilling into the earth.
Figure 14:
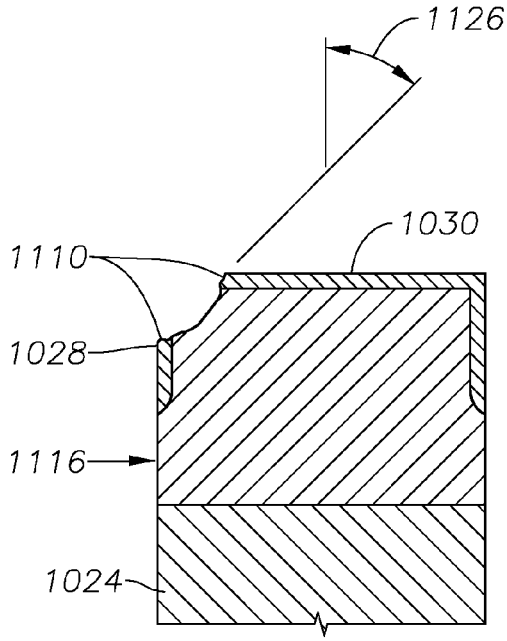
FIG. 14 is a sectional view of the cutter of FIG. 7 in a worn condition.

In time, however, as shown in FIGS. 12A and 14, the cutter 1116 wears until only a small part of the working surface 1028 has the lip 1110. The lifetime of this cutter 1116 is dependent, therefore upon the how far down the outside periphery 1124 the treatment extends, and the wear angle 1126 (shown in FIG. 14). It is also dependent upon other factors including the rate of penetration and the interaction of the cutter with radially adjacent cutters. Wear angle 1126 is generally an angle complimentary to the backrake 1106 of the cutter, but may also be profoundly related to the type of formation drilled, the manner in which the drill bit is operated, and the thickness of the wear resistant layer.

Figure 8:
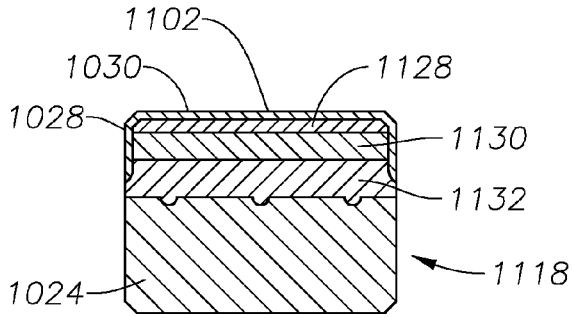
FIG. 8 is a section view of an alternative planar face PDC cutting element of the present invention.

Other ways of producing wear resistant layers which produce lips 110 are disclosed in FIGS. 8, 9A, 9B, 15 and 16. In FIG. 8 shown is a cutter 1118 with multiple layers 1128, 1130, 1132 of diamond material. These layers may be of differing thicknesses and comprised of diamond crystals of differing particle size, and volume density. In addition, these layers may contain encapsulated diamond material which has been pre-synthesized. For example, diamond material made with powdery carbonates or other means. The diamond material in these multiple layers 1128, 1130, 1132 may be further treated to removed the catalyzing material forming a treated layer 1102 superimposed upon the discreet diamond layers 1128, 1130, 1132.

Figure 15:
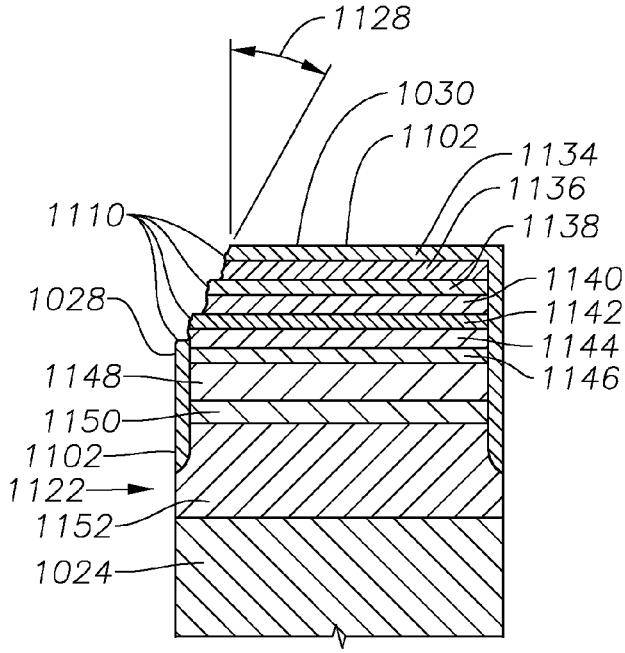
FIG. 15 is a sectional view of another embodiment of a cutter of the present invention in a worn condition.

The arrangement of FIG. 15 includes a number of discrete layers 1134, 1136, 1138, 1140, 1142, 1144, 1146, 1148, 1150 1152. Under certain drill bit 1012 applications where the wear angle 1128 may be quite steep, it may be advantageous to have layers in this manner. Again treated layer 1102 is provided.

Figure 9A:
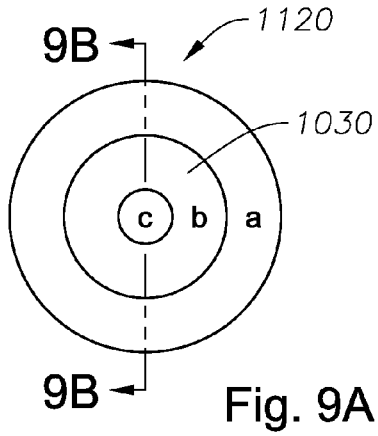
FIG. 9A is a top view of another embodiment of a planar face PCD cutting element of the present invention.
Figure 9B:
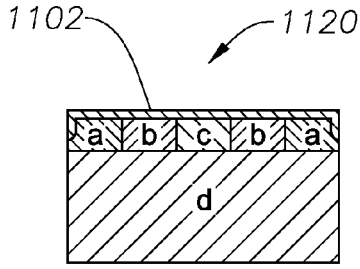
FIG. 9B is a cross-section view through section X-X of the planar face PCD cutting element of FIG. 9A.
Figure 16:
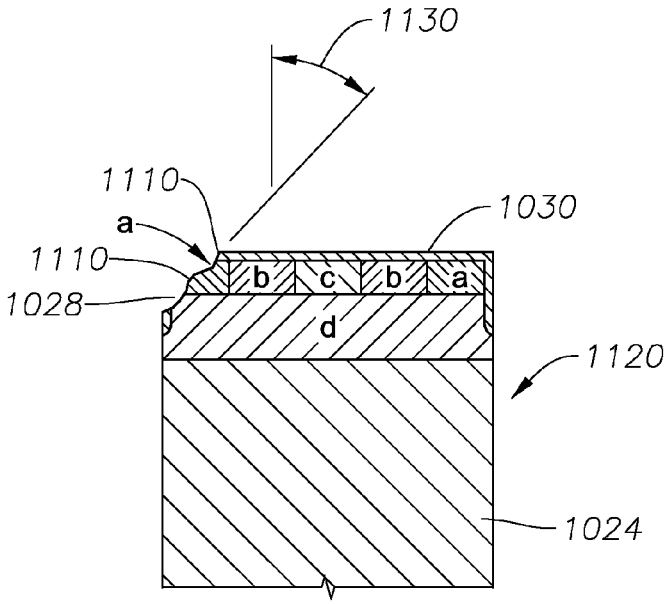
FIG. 16 is a sectional view of the cutter of FIGS. 9A and 9B in a worn condition.

Finally, concentric rings identified by the letters a, b, and c, with base material d in FIGS. 9A and 9B may also effectively provide a cutter 1120 with multiple lips. In this instance, as indicated in FIG. 16, they may be negative—that is material a produces a lips 1110 which stands apart from the base diamond material d and ring b. This effectively forms double lips in adjacent materials a and b, particularly if the wear angle 1130 is quite high. A treated layer 1102 may, again, be provided.

Each of the configurations as disclosed in FIGS. 7, 8, 9A, 9B and 15 can apply equally as well to both the 'standard' geometry shown in FIG. 10 and the truncated cone geometry of FIG. 11. One advantage of the geometry shown in FIG. 11, however, is that minimal wear of the diamond surface is necessary for a plurality of lips 1110 to form.

The invention encompasses, as well as the cutting element, a method of manufacture thereof. The method comprises forming a table of superhard material bonded to a substrate of a less hard material. The table defines a plurality of interstices containing a catalyzing material. End and peripheral working surfaces are defined by the table. The method involves treating at least part of the end working surface and at least part of the peripheral working surface to remove the catalyzing material therefrom. The treatment may comprise a leaching operation.

Whereas the present invention has been described in particular relation to the drawings attached hereto, it should be understood that other and further modifications apart from those shown or suggested herein, may be made within the scope and spirit of the present invention.

What is claimed is:

1. A method of making a cutting element comprising:

forming a continuous table of polycrystalline diamond material integrally bonded to a tungsten carbide substrate comprising a facing table having a generally planar, generally circular end working surface, and a generally cylindrical peripheral working surface;

treating at least part of each of the end working surface and the peripheral working surface to remove catalyzing material therefrom, exposing untreated superhard material between the end and peripheral working surfaces, by machining away the polycrystalline diamond material, preferentially wearing the exposed, untreated polycrystalline diamond material of the cutting element forming a pair of protruding lips with diamond material which is continuous between the protruding lips, wherein the step of preferentially wearing the exposed, untreated polycrystalline diamond material comprises machining away the polycrystalline diamond material.

* * * * *